US009099789B1

(12) United States Patent
Modro

(10) Patent No.: US 9,099,789 B1
(45) Date of Patent: Aug. 4, 2015

(54) DUAL-BAND INVERTED SLOT ANTENNA

(71) Applicant: AMAZON TECHNOLOGIES, INC., Reno, NV (US)

(72) Inventor: Joseph Christopher Modro, Palo Alto, CA (US)

(73) Assignee: Amazon Technologies, Inc., Reno, NV (US)

( * ) Notice: Subject to any disclaimer, the term of this patent is extended or adjusted under 35 U.S.C. 154(b) by 301 days.

(21) Appl. No.: 13/712,875

(22) Filed: Dec. 12, 2012

Related U.S. Application Data

(60) Provisional application No. 61/697,235, filed on Sep. 5, 2012.

(51) Int. Cl.
*H01Q 13/10* (2006.01)

(52) U.S. Cl.
CPC ..... *H01Q 13/106* (2013.01)

(58) Field of Classification Search
CPC ..... H01Q 13/00; H01Q 1/38; H01Q 1/24; H01Q 1/24
USPC ..... 343/767, 702, 700 MS, 846
See application file for complete search history.

(56) References Cited

U.S. PATENT DOCUMENTS

| | | | | |
|---|---|---|---|---|
| 6,043,785 | A * | 3/2000 | Marino | 343/767 |
| 7,592,968 | B2 * | 9/2009 | Modro | 343/873 |
| 7,646,341 | B1 * | 1/2010 | Lin et al. | 343/700 MS |
| 2003/0103010 | A1 * | 6/2003 | Boyle | 343/702 |
| 2005/0248488 | A1 * | 11/2005 | Modro | 343/700 MS |
| 2006/0050002 | A1 * | 3/2006 | Wang et al. | 343/767 |

OTHER PUBLICATIONS

Kishan Singh, A novel design of square microstrip antenna for dual band operation, 2011, International hournal of electronics engineering, Serials publication, ISSN:0973-7383, pp. 349-352.*

* cited by examiner

*Primary Examiner* — Huedung Mancuso
(74) *Attorney, Agent, or Firm* — Lowenstein Sandler LLP

(57) ABSTRACT

Methods and systems for radiating electromagnetic energy with a dual-band inverted slot antenna are described. The dual-band inverted slot antenna may be formed of a metallic member with two open ends at one or more edges of the metallic member. The inverted slot antenna is configured to radiate electromagnetic energy in response to the RF signal at two resonant modes.

25 Claims, 8 Drawing Sheets

DUAL-BAND INVERTED SLOT ANTENNA

RELATED APPLICATIONS

This application claims the benefit of U.S. Provisional Application No. 61/697,235, filed Sep. 5, 2012, the entire contents of which are incorporated by reference.

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas. Various types of antennas can be used in user devices.

A slot antenna typically includes a metal surface with a slot opening, hole, or slot cut out. When the metal surface is driven as an antenna by a driving frequency, the slot opening radiates electromagnetic waves in a similar way to a dipole antenna. The shape and size of the slot opening, as well as the driving frequency, determine the radiation distribution pattern. A slot antenna's main advantages are its size, design simplicity, robustness and convenient adaptation to mass production using printed circuit board (PCB) technology.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Methods and systems for radiating electromagnetic energy with a dual-band inverted slot antenna are described. The dual-band inverted slot antenna may be formed of a metal member of an electronic device (also referred to herein as user device) and a feed location to be directly coupled to receive a radio frequency (RF) signal. The dual-band inverted slot antenna is configured to radiate electromagnetic energy in response to the RF signal. In one embodiment, the slot antenna can be configured to operate as a dual-band inverted slot antenna for WLAN frequency bands, such as the dual-band Wi-Fi frequency band. The slot antenna may be formed with a structural member of the user device. Alternatively, the slot antenna may be formed with a non-structural member of the user device. For example, the structural member may be a metallic support member that supports a display of the user device, a circuit board, or a user input device of the user device. The structural member may also be a metallic housing of the user device, a metal portion of a non-metallic housing of the user device, a metallic bezel or the like. The structural or non-structural member may be metal, metal alloy, or the like. The slot antenna may be a two-dimensional (2D) structure or a three-dimensional (3D) structure.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
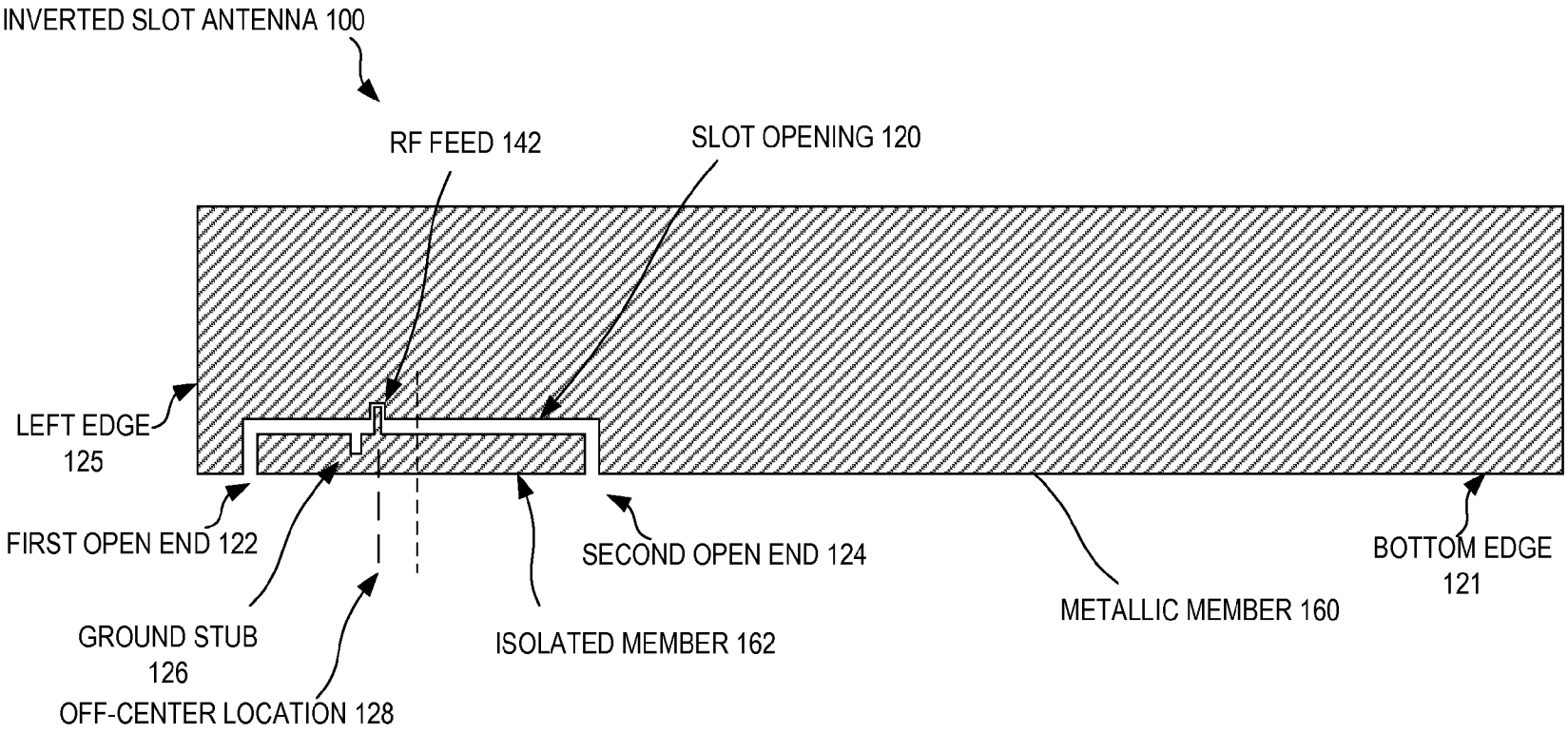
FIG. 1 illustrates a top view of a dual-band inverted slot antenna including a slot opening with two open ends, a RF feed, and a ground stub disposed on a left side according to one embodiment.

FIG. 1 illustrates a top view of a dual-band inverted slot antenna 100 including a slot opening 120 with two open ends 122, 124, a RF feed 142, and a ground stub 126 disposed on a left side of the RF feed 142 according to one embodiment. The dual-band inverted slot antenna 100 is formed in the material of a metallic member 160. In one embodiment, the metallic member 160 is a ground plane of a circuit board. The ground plane may be a system ground or one of multiple grounds of the user device. Alternatively, the metallic member 160 may be a metallic support member of a display, a touchpad, or a touchscreen of the user device, a metallic housing, a metallic portion of a non-metallic housing, a metallic bezel, a metallic support member of a circuit board, such as a printed circuit board (PCB), or metallic support members of other existing components, such as keyboards, buttons, displays, circuits, or the like. This metal member may also be non-structural, such as a metal member that is used for decorative or aesthetic purposes.

In this embodiment, the dual-band inverted slot antenna 100 (hereinafter inverted slot antenna 100) is a three-sided slot opening 120 with two open ends 122,124 at an edge of the metallic member 160 (at the bottom edge 121 in the depicted embodiment). A "slot opening" is a cut out, a hole or other opening in the metallic member 160. The dimensions of the slot opening contribute to the flow of current when the RF feed 142 drives the inverted slot antenna 100. When the metal surface is driven as an antenna by a driving frequency, the slot opening radiates electromagnetic waves in a similar way to a dipole antenna. The shape and size of the slot opening, as well as the driving frequency, determine the radiation distribution pattern. A slot antenna's main advantages are its size, design simplicity, robustness and convenient adaptation to mass production using PCB technology. In the depicted embodiment, the slot opening 120 extends up from the first open end 122 in a first L-shape and from the second open end 124 as a second L-shape. In other embodiments, the corners could be cut off of the L-shaped to form other slot shapes. For example, the first open end 122 may be a second edge (e.g., left edge 125) of the metallic member 160, and the second open end 124 remains at the first edge (e.g., bottom edge 121) of the metallic member 160. In the depicted embodiment, the slot opening 120 is a continuous opening between the first open end 122 and the second open end 124, which forms an isolated member 162 of metal. The first open end 122 and the second open end 124 cause open circuits at the two open ends 122, 124 and an effective short in the middle when the structure is radiated. This structure of a slot opening with two open ends 122, 124 is considered an inverted slot antenna. The conventional way that the slot antenna works is that it is typically a half wavelength resonance with short circuits at both ends and an open circuit in the middle. The inverted slot antenna 100 is inverted to include two open circuits at each end and an effective short in the middle.

In another embodiment, the three-sided slot opening 120 includes three portions: a first side portion, a middle portion and a second side portion. The first side portion extends from the first open end 122 at the edge of the metallic member 160 towards a first bend in a first direction. The middle portion extends from the first bend towards a second bend in a second direction that is substantially perpendicular to the first direction. The second side portion that extends from the second bend towards the second open end 124 at the edge of the metallic member 160 in a third direction that is substantially parallel to the first direction. In a further embodiment, the ground stub 126 extends out from the middle portion in the third direction. The ground stub 126 is a short projecting slot opening that extends out from the middle portion of the three-sided slot opening. In the depicted embodiment, the ground stub 126 is open at one end that adjoins the slot opening of the middle portion and extends towards the same edge as the first open end 122 and the second open end 124, but does not extend all the way to the edge. Typically, a stub is a length of transmission line or waveguide that is connected at one end only. In this case, the stub is implemented as a slot opening that is electrically connected to the middle portion at one end, but is an opening that extends out from the slot opening of the middle portion. The ground stub 126 is configured to split the low-band and the high-band, and can be used for tuning. The ground stub 126 can be used to separate the resonant modes at the low frequency resonance and the high frequency resonance. This is unlike conventional slot antennas that have a thin line cut out of the ground plane in which the two ends are shorted and the slot antenna is fed in the middle. The conventional slot antenna is a half wavelength resonance, whereas the low-band in the inverted slot antenna 100 has an inverted half-wavelength current distribution along the whole slot for the low-band (mode 1) and a ¾wavelength distribution along most of the slot (e.g., from the second slot opening 124 to the ground stub 126.

The RF feed 142 may be a feed line connector that couples the inverted slot antenna 100 to a feed line (also referred to as the transmission line), which is a physical connection that carriers the RF signal to and/or from the inverted slot antenna 100. The feed line connector may be any one of the three common types of feed lines, including coaxial feed lines, twin-lead lines, waveguides, or the track as described herein. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to inverted slot antenna 100 via the RF feed 142. Different feeding mechanisms can be used, such as a track feed, a co-planar feed, a trace feed, a coaxial feed, twin-lead lines, a waveguide or the like. The coplanar feed may be coplanar with the metallic member 160 (e.g., ground plane).

Figure 2:
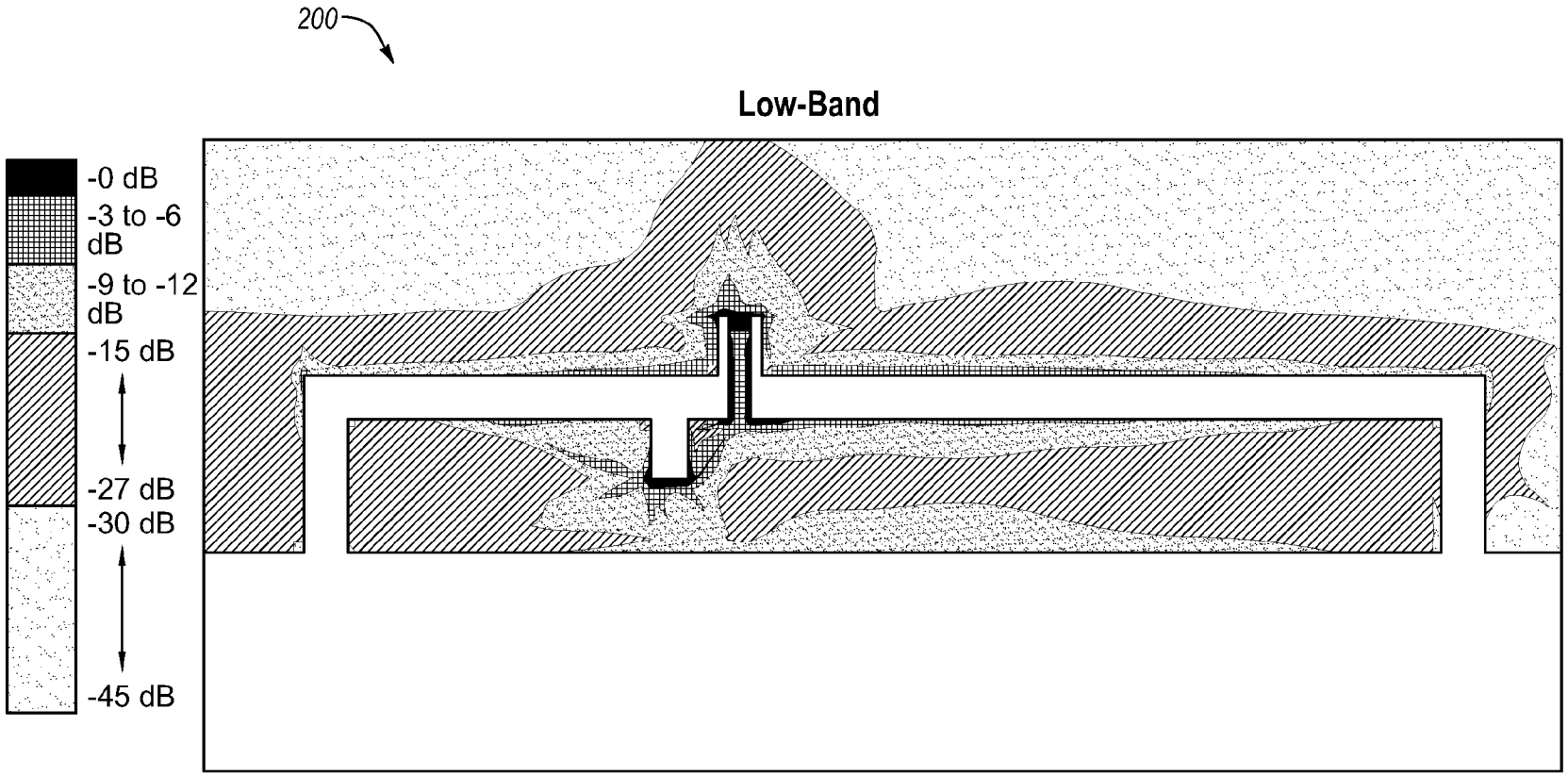
FIG. 2 is a plot of current density principal modal resonance for the inverted slot antenna of FIG. 1 at a low-band of a wireless local area network (WLAN) frequency band according to one embodiment.

In the depicted embodiment, the three-sided slot opening 120 is a continuous slot opening. For example, at the RF feed 142, the slot opening 120 includes two slot segments that extend away from the longitudinal axis away from the edge of the metallic member 160 and connect at a third slot segment between the top of the two slot segments. In another embodiment, the middle portion includes two separate slot openings and the RF feed 142 is coupled to feed the two separate slot openings. For example, a segment of the metallic member 160 may exist between the two slot segments (as illustrated in FIG. 2). Alternatively, the slot opening 120 can have one or more slot openings that operate as two open circuits at the first open end 122 and the second open end 124, and a short circuit near the middle portion as would be appreciated by one of ordinary skill in the art having the benefit of this disclosure.

It should be noted that electrical field of a slot antenna is constrained across the slot so that the actual field will be at right angles to the axis of the slot. Embodiments of the inverted slot antenna 100 allow the miniaturization of the antenna, providing a smaller antenna design than conventional antenna structure.

In another embodiment, the inverted slot antenna 100 has three sides, a first side that extends up from the first slot opening 122 at the edge of the metallic member 160, a second side that extends from a top of the first side to a stop of a third side, the third side extending up from the second slot opening 124. The second side includes a first stub as the RF feed 142 and a ground stub 126.

In another embodiment, the inverted slot antenna 100 is formed in the ground plane and coupled to the RF feed 142. The inverted slot antenna includes a slot opening having a first end (e.g., 120) a second end (e.g., 122) that are disposed at an edge of the ground plane to cause open circuits when the inverted slot antenna is radiated. The inverted slot antenna 100 is fed in the middle. In one embodiment, the inverted slot antenna 100 is fed at the RF feed 142 disposed at an off-center location 128 of the elongated slot opening, such as shown in the depicted embodiment. In one embodiment, the elongated slot opening is a continuous opening that physically forms the isolated member 162 disposed in between the inverted slot opening and the edge. The isolated member 162 may be a floating metallic member. The floating metallic member may be metal that is physically separated from the metallic member (e.g., ground plane) by the continuous opening. In one embodiment, the RF feed 142 comes from the metallic member 160 and goes across the slot to the isolated member 162 near a slot stub in the slot. The slot opening 120 at the RF feed 142 (or the isolated member 162) can be excited to induce surface currents to radiate electromagnetic energy from the slot.

In the depicted embodiment, the inverted slot antenna 100 includes a first slot segment disposed along a longitudinal axis of the inverted slot antenna 100 to a first side of the RF feed 142, a second slot segment disposed along the longitudinal axis to a second side of the RF feed 142, a third slot segment coupled to the first slot segment at a first bend of the inverted slot antenna 100. The third slot segment is substantially orthogonal to the first slot segment. The inverted slot antenna 100 also includes a fourth slot segment coupled to the second slot segment at a second bend of the inverted slot antenna 100. The fourth slot segment is substantially orthogonal to the second slot segment. The open circuits are at distal ends of the third and fourth slot segments. As described above, the distal ends of the third and fourth slot segments are disposed on a same edge of the ground plane. In another embodiment, the first end of the inverted slot antenna is at first edge of the ground plane, and the second end of the inverted slot antenna is at the second edge of the ground plane.

It should be noted that the RF feed 142 and the ground stub 126 are disposed in an off-center position. In the depicted embodiment, the RF feed 142 is disposed to the right of the ground stub 126, and both are disposed in a left-of-center position. Alternatively, the RF feed 142 can be disposed on the right side of the ground stub 126, and both are disposed in a right-of-center position. In other embodiments, the RF feed 142 and ground stub 126 can be disposed in other locations. As described herein, the ground stub 126 is used to separate the low-band and high-band resonant modes. For example, the ground stub 126 can be used to tune the first resonant mode for a low-band WLAN band and the second resonant mode for a high-band WLAN band.

In one embodiment, the metallic member 160 is a structural member of the user device. The structural member may be a metallic support member that supports a circuit board of the user device, a metallic support member that supports a display of the user device, a metallic support member that supports a user input device, a metal back panel of an assembly that supports the circuit board, a metallic housing of the user device, a metal portion of a non-metallic housing of the user device, or a metallic bezel of the user device. Alternatively, the structural member may be a metallic support member that supports a user input device, such as a touch screen, touchpad, or touch panel. Alternatively, other structural members of the user device may be used. In other embodiments, the metallic member 160 is a non-structural member of the user device, such as metal that is used for ornamental or aesthetic purposes.

In the depicted embodiment, the inverted slot antenna 100 is configured to radiate at an opening between the slot opening 120 and the metallic member 160. The slot opening 120 is configured to operate as a dual-band inverted slot antenna radiator with the RF feed 142 and ground stub 126. The feed location, the distance between the feed location and the grounding point, and the area of the slot opening 120 contribute to resonant frequencies of the inverted slot antenna 100. In one embodiment, the slot opening 120 is configured to operate as a dual-band WLAN antenna. Most modern WLAN antennas are based on IEEE 802.11 standards, marketed under the Wi-Fi brand name. The WLAN antenna may cover a WLAN frequency band, such as the WiFi frequency bands of 2.45 GHZ, 5 GHz or both. The Wi-Fi frequency bands may also include 3.7 GHz. In one embodiment, the inverted slot antenna 100 is configured to provide multiple resonant modes. In one embodiment, the inverted slot antenna 100 is configured to provide a first resonant mode and a second resonant mode. In one embodiment, the first resonant mode covers a first Wi-Fi frequency band and the second resonant mode covers a second Wi-Fi frequency band. In another embodiment, the first frequency band is a 2.45 GHz frequency band and the second frequency band is 5.8 GHz frequency band. Alternatively, the inverted slot antenna 100 can be configured to radiate at other frequency ranges as would be appreciated by one of ordinary skill in the art having the benefit of this disclosure. For example, other frequency bands may be achieved by changing the feed location, the distance between the feed location and the grounding point, the area of the slot opening 120, as well as other dimensions of the inverted slot antenna 100.

In some embodiments, the slot opening 120 is an air gap. In another embodiment, dielectric material may be disposed between the slot opening 120 and the metallic member 160.

FIG. 2 is a plot 200 of current density principal modal resonance for the inverted slot antenna 100 of FIG. 1 at a low-band of a wireless local area network (WLAN) frequency band according to one embodiment. In this embodiment, the inverted-slot antenna 100 is operating at 2.44 GHz for the Wi-Fi low band. As shown in FIG. 2, the current density distribution is along both edges of elongated slot opening. The plot of FIG. 2 has been converted from a color graph with the different colors representing the different magnitudes of current. The different magnitudes are separated by lines to illustrate the areas of the metal that have more current in the low-band.

Figure 3:
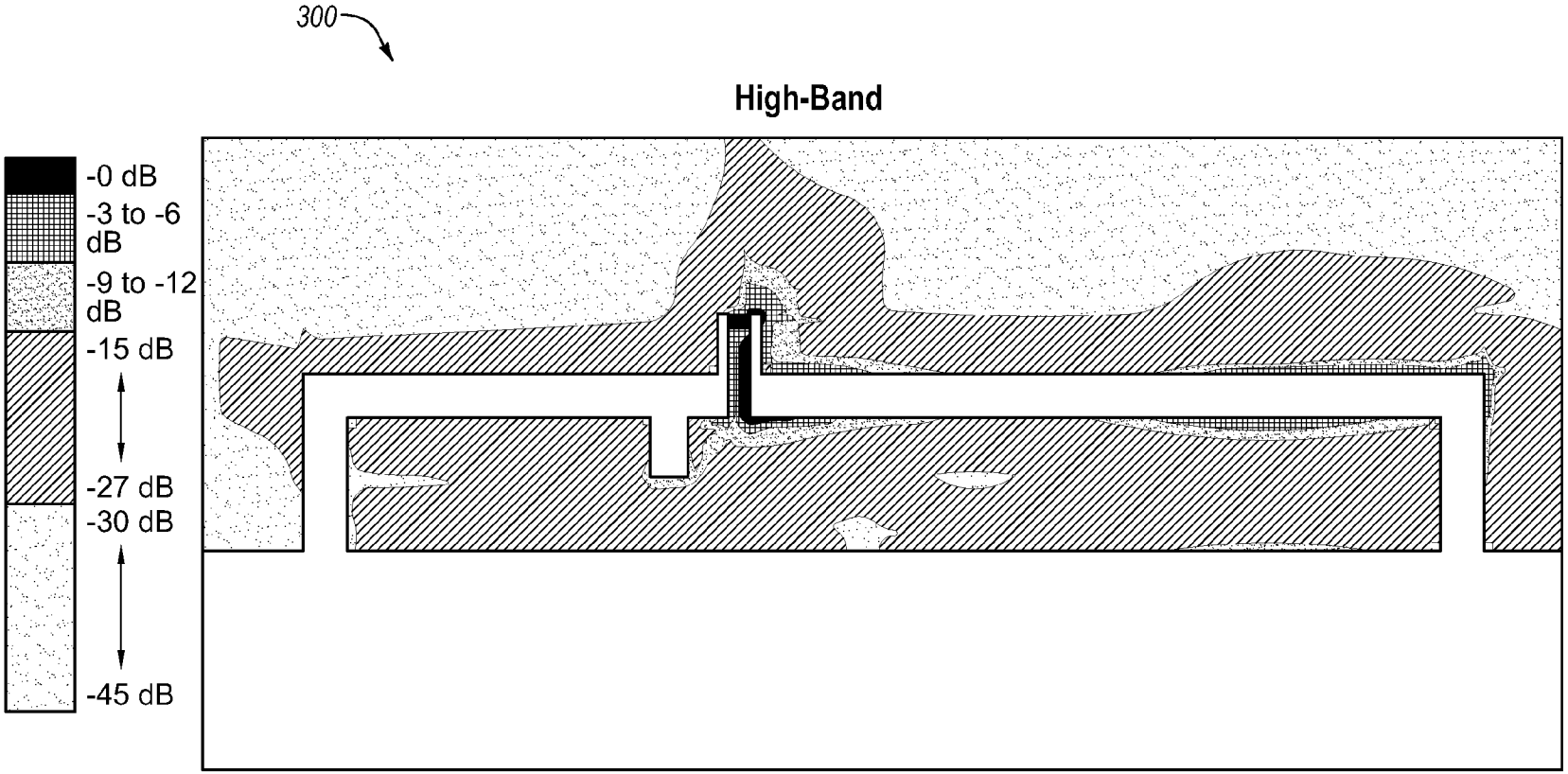
FIG. 3 is a plot of current density principal modal resonance for the inverted slot antenna of FIG. 1 at a high-band of the WLAN frequency band according to one embodiment.

FIG. 3 is a plot 300 of current density principal modal resonance for the inverted slot antenna 100 of FIG. 1 at a high-band of the WLAN frequency band according to one embodiment. In this embodiment, the inverted-slot antenna 100 is operating at 5.5 GHz for the Wi-Fi high band. As shown in FIG. 3, the current density distribution is along both edges of the slot opening on the right side. Similarly, the plot of FIG. 3 has been converted from a color graph with the different colors representing the different magnitudes of current. The different magnitudes are separated by lines to illustrate the areas of the metal that have more current in the high-band. The plots 200 and 300 of FIGS. 2-3 illustrate the first open end and the second open ends of the slot opening as being open circuits, wherein the ground stub operates as a short circuit in the middle portion of the slot opening. It should be noted that although the color graph shows gradual changes in magnitude, FIGS. 2-3 illustrate the same information regarding the magnitude of the current distribution on the metallic member in the low-band and high-band of the WLAN frequency band.

The plots of FIGS. 2 & 3 illustrate the average-current and show the inverted half-wavelength current distribution along the whole slot for the low-band resonant mode (Mode 1) in FIG. 2, and the ¾-wavelength distribution along most of the slot (from the open end 122 to the ground stub 126 (e.g., 'stub-slot' near the feed 142) for the high-band resonant mode (Mode 2).

Figure 4:
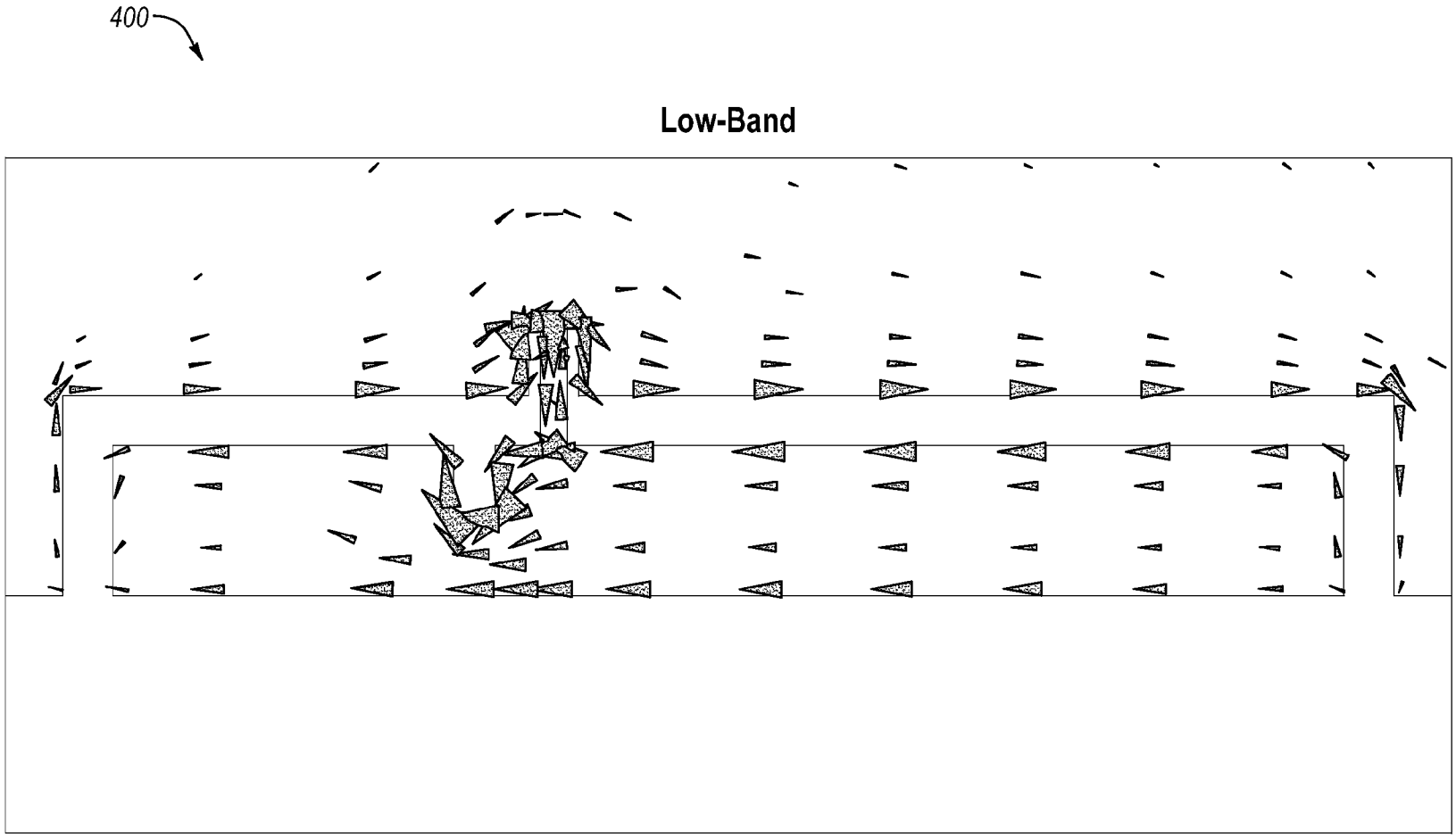
FIG. 4 is a vector current plot illustrating the current directions and current magnitudes for the inverted slot antenna of FIG. 1 at the low-band of the WLAN frequency band according to one embodiment.

FIG. 4 is a vector current plot 400 illustrating the current directions and current magnitudes for the inverted slot antenna 100 of FIG. 1 at the low-band of the WLAN frequency band according to one embodiment. The vector current plot 400 includes arrows that represent a direction of the current, as well as the magnitude of the current by way of the size of the arrows. As shown in the vector current plot 400, the current is concentrated near the RF feed and the ground stub, but there is current that flows along both edges of the slot opening in the low-band. The vector current plot 400 shows that the inverted slot antenna operates as a half-wavelength antenna in the low-band. The low-band half-wavelength mode includes high lateral current density half-way along the slot and zero lateral current density at both open ends of the slot.

Figure 5:
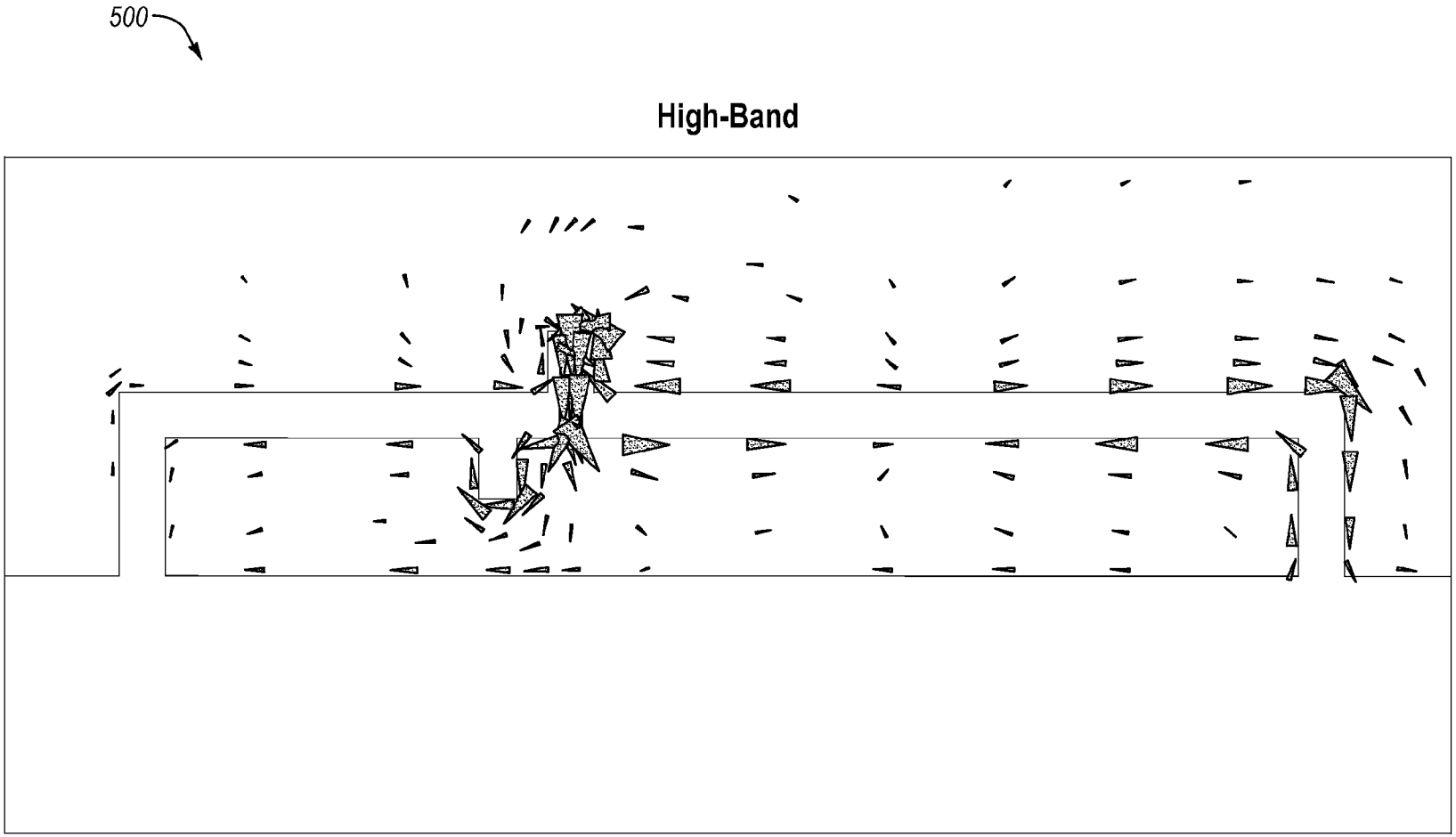
FIG. 5 is a vector current plot illustrating the current directions and current magnitudes for the inverted slot antenna of FIG. 1 at the high-band of the WLAN frequency band according to one embodiment.

FIG. 5 is a vector current plot 500 illustrating the current directions and current magnitudes for the inverted slot antenna 100 of FIG. 1 at the high-band of the WLAN frequency band according to one embodiment. Similar to above, the vector current plot 500 includes arrows that represent a direction of the current, as well as the magnitude of the current by way of the size of the arrows. As shown in the vector current plot 500, the current is concentrated near the RF feed and the ground stub, but there is current that flows in both directions along both edges of the slot opening in the high-band. The vector current plot 500 shows that the inverted slot antenna operates at a ¾-wavelength antenna in the high-band. The high-band ¾-wavelength mode is formed by a high-positive, then low-positive then high-negative then low-negative current density as one moves one's observation point from the slot-stub region along to the right-most open end of the main slot.

The vector current plots of FIG. 4 & FIG. 5 show the two modes' current directions as well as magnitude. The magnitude is proportional to the size of the cones in the vector current plots. The reflection coefficient of a typically dual-band inverted slot antenna is illustrated and described below with respect to FIG. 8.

Figure 6:
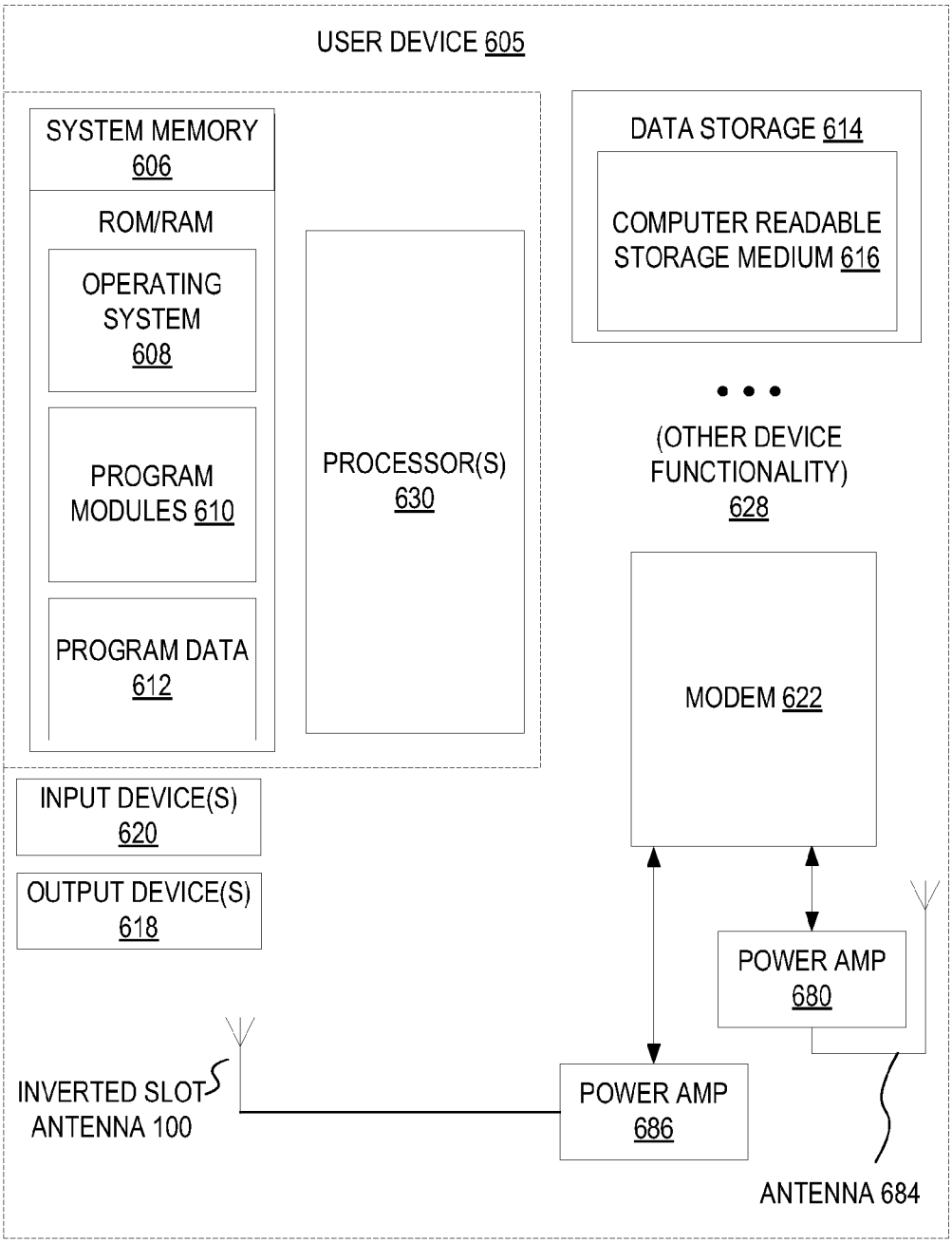
FIG. 6 is a block diagram of a user device having a dual-band inverted slot antenna of FIG. 1 according to one embodiment.

FIG. 6 is a block diagram of a user device 605 having a dual-band inverted slot antenna 100 according to one embodiment. The user device 605 includes one or more processors 630, such as one or more CPUs, microcontrollers, field programmable gate arrays, or other types of processing devices. The user device 605 also includes system memory 606, which may correspond to any combination of volatile and/or non-volatile storage mechanisms. The system memory 606 stores information that provides an operating system component 608, various program modules 610, program data 612, and/or other components. The user device 605 performs functions by using the processor(s) 630 to execute instructions provided by the system memory 606.

The user device 605 also includes a data storage device 614 that may be composed of one or more types of removable storage and/or one or more types of non-removable storage. The data storage device 614 includes a computer-readable storage medium 616 on which is stored one or more sets of instructions embodying any one or more of the functions of the user device 605, as described herein. As shown, instructions may reside, completely or at least partially, within the computer readable storage medium 616, system memory 606 and/or within the processor(s) 630 during execution thereof by the user device 605, the system memory 606 and the processor(s) 630 constituting computer-readable media. The user device 605 may also include one or more input devices 620 (keyboard, mouse device, specialized selection keys, etc.) and one or more output devices 618 (displays, printers, audio output mechanisms, etc.).

The user device 605 further includes a wireless modem 622 to allow the user device 605 to communicate via a wireless network (e.g., such as provided by a wireless communication system) with other computing devices, such as remote computers, an item providing system, and so forth. The wireless modem 622 allows the user device 605 to handle both voice and non-voice communications (such as communications for text messages, multimedia messages, media downloads, web browsing, etc.) with a wireless communication system. The wireless modem 622 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WiFi, etc. In other embodiments, the wireless modem 622 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 605 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 605 to communicate with other devices, such as other user devices, server computing systems, telephone devices, or the like. In addition to wirelessly connecting to a wireless communication system, the user device 605 may also wirelessly connect with other user devices. For example, user device 605 may form a wireless ad hoc (peer-to-peer) network with another user device.

The wireless modem 622 may generate signals and send these signals to power amplifier (amp) 680 or power amp 686 for amplification, after which they are wirelessly transmitted via the dual-band inverted slot antenna 100 or antenna 684, respectively. The dual-band inverted slot antenna 100 may be any one of the dual-band inverted slot antennas described herein, including, but not limited to dual-band inverted slot antenna 100. Although FIG. 6 illustrates power amps 680 and 686, in other embodiments, a transceiver may be used to all the antennas 100 and 684 to transmit and receive. The antenna 684, which is an optional antenna that is separate from the dual-band inverted slot antenna 100, may be any directional, omnidirectional or non-directional antenna in a different frequency band than the frequency bands of the dual-band inverted slot antenna 100. The antenna 684 may also transmit information using different wireless communication protocols than the dual-band inverted slot antenna 100. In addition to sending data, the dual-band inverted slot antenna 100 and the antenna 684 also receive data, which is sent to wireless modem 622 and transferred to processor(s) 630. It should be noted that, in other embodiments, the user device 605 may include more or less components as illustrated in the block diagram of FIG. 6.

In one embodiment, the user device 605 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the dual-band inverted slot antenna 600 that operates at a first frequency band and the second wireless connection is associated with a second resonant mode of the dual-band inverted slot antenna 600 that operates at a second frequency band. In another embodiment, the first wireless connection is associated with the dual-band inverted slot antenna 600 and the second wireless connection is associated with the antenna 684. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 622 is shown to control transmission to both antennas 600 and 684, the user device 605 may alternatively include multiple wireless modems, each of which is configured to transmit/receive data via a different antenna and/or wireless transmission protocol. In addition, the user device 605, while illustrated with two antennas 600 and 684, may include more or fewer antennas in various embodiments.

The user device 605 delivers and/or receives items, upgrades, and/or other information via the network. For example, the user device 605 may download or receive items from an item providing system. The item providing system receives various requests, instructions and other data from the user device 605 via the network. The item providing system may include one or more machines (e.g., one or more server computer systems, routers, gateways, etc.) that have processing and storage capabilities to provide the above functionality. Communication between the item providing system and the user device 605 may be enabled via any communication infrastructure. One example of such an infrastructure includes a combination of a wide area network (WAN) and wireless infrastructure, which allows a user to use the user device 605 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 605.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 605 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 605 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 7:
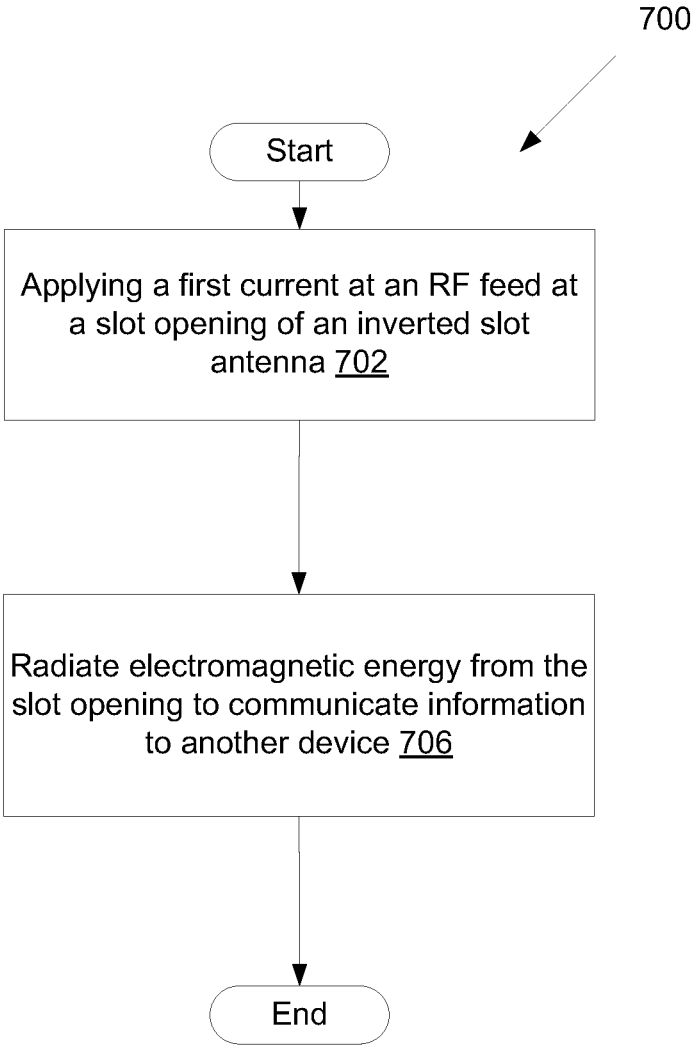
FIG. 7 is a flow diagram of an embodiment of a method of operating a user device having a dual-band inverted slot antenna according to one embodiment.

FIG. 7 is a flow diagram of an embodiment of a method 700 of operating a user device having a dual-band inverted slot antenna according to one embodiment. In method 700, a current is applied at an RF feed coupled to a slot opening 120 to provide multiple resonant modes (block 702). It should be noted that the first current is applied based on the type of RF feed and transmission line are being used. This may be by induction or by conduction as would be appreciated by one of ordinary skill in the art having the benefit of this disclosure. In response, the slot opening radiates electromagnetic energy to communicate information to another device (block 704). The electromagnetic energy forms a radiation pattern. The radiation pattern may be various shapes as would be appreciated by one of ordinary skill in the art having the benefit of this disclosure.

In one embodiment, a current is induced at the RF feed, which induces a surface current flow around the slot opening. The slot opening radiates electromagnetic energy in two resonant modes, including a low-band resonant mode and a high-band resonant mode as described herein.

Figure 8:
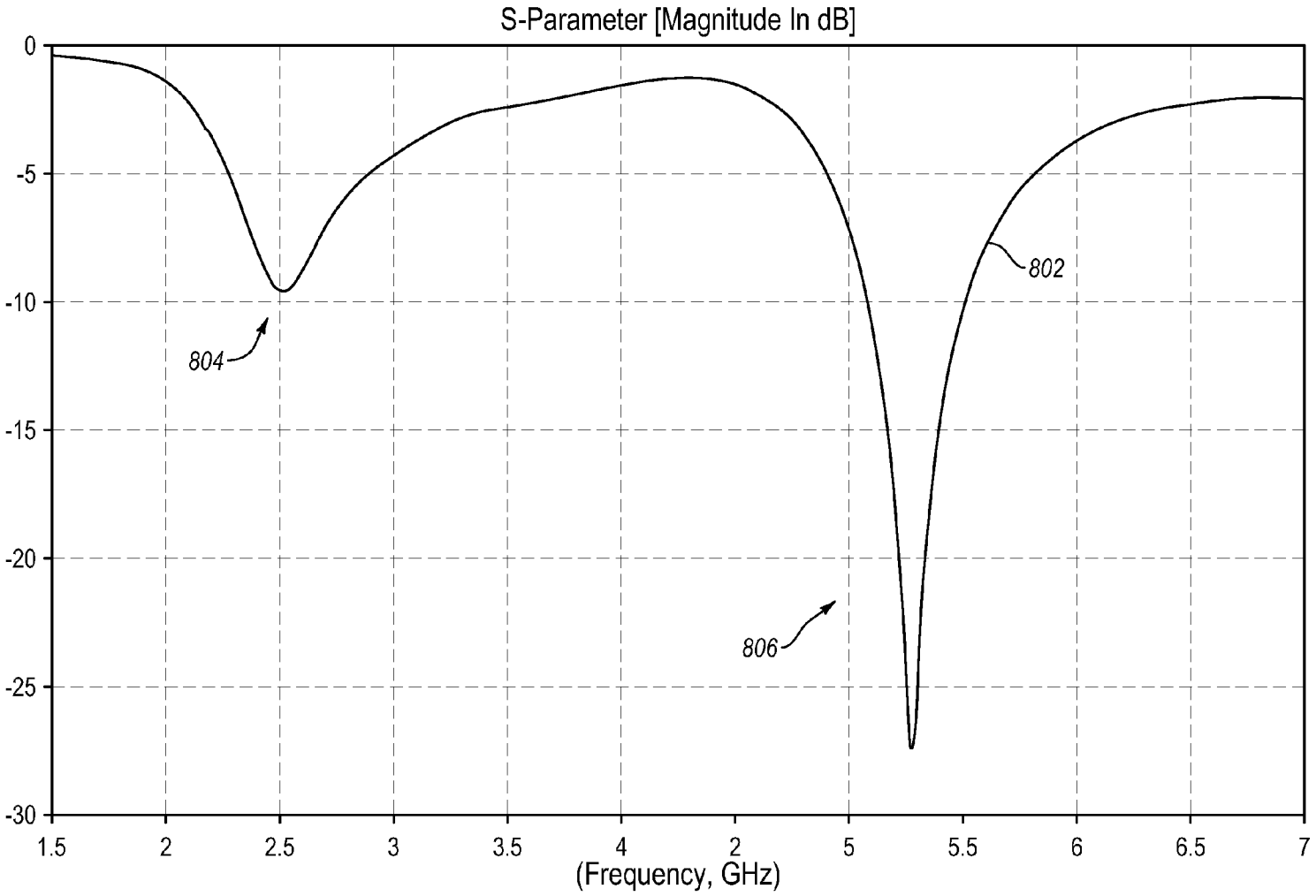
FIG. 8 is a graph of the reflection coefficient of a dual-band inverted slot antenna according to one embodiment.

FIG. 8 is a graph 800 of the reflection coefficient 802 of a dual-band inverted slot antenna according to one embodiment. The graph 800 shows the measured reflection coefficient (also referred to S-parameter or |S 11|) 802 of the dual-band inverted slot antenna, such as dual-band inverted slot antenna 100 of FIG. 1. The dual-band inverted slot antenna covers approximately 2.2 GHz to 2.8 GHz in a low-band resonant mode 804 and 4.8 GHz to 5.8 GHz in a high-band resonant mode 806. As described herein, other resonant modes may be achieved. It should also be noted that the first and second notations on the resonant modes are not be strictly interpreted to being assigned to a particular frequency, frequency range, or elements of the antenna structure. Rather, the first and second notations are used for ease of description. However, in some instances, the first and second notations are used to designate the order from lowest to highest frequencies. Alternatively, other orders may be achieved as would be appreciated by one of ordinary skill in the art having the benefit of this disclosure.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "applying," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. An electronic device comprising:

a circuit board comprising a transceiver and a ground plane;

a radio frequency (RF) feed coupled to the transceiver; and an inverted slot antenna comprising a slot opening in the ground plane and a ground stub, wherein the slot opening comprises: a middle portion, a first side portion, and a second side portion, wherein the first side portion extends to an edge of the ground plane to cause a first open circuit when the inverted slot antenna is radiating and the second side portion extends to the edge to cause a second open circuit when the inverted slot antenna is radiating, wherein the ground stub extends out from the middle portion to cause a short circuit when the inverted slot antenna is radiated, wherein the RF feed is disposed in the middle portion to feed the inverted slot antenna.

2. The electronic device of claim 1, wherein the RF feed is disposed at an off-center location of the middle portion.

3. The electronic device of claim 1, wherein:

the first side portion and the second side portion extend to the same edge of the ground plane, and the electronic device comprises a floating metallic member disposed in between the inverted slot opening and the same edge.

4. The electronic device of claim 3, wherein:

the ground stub extends from the middle portion into the floating metallic member, and the RF feed extends from the middle portion away from the floating metallic member.

5. The electronic device of claim 1, wherein the inverted slot antenna is configured to:

radiate electromagnetic energy in a first frequency range of a wireless local area network (WLAN) frequency band; and radiate electromagnetic energy in a second frequency range of the WLAN frequency band, wherein the second frequency range is higher than the first frequency range.

6. An apparatus comprising:

a radio frequency (RF) feed; and an inverted slot antenna formed in a metallic member, wherein the inverted slot antenna comprises:

an elongated opening comprising a first end and a second end, wherein the first end and the second end are disposed at an edge of a ground plane to operate as open circuits when the inverted slot antenna is radiating;

a first slot segment disposed along a longitudinal axis of the inverted slot antenna to a first side of the RF feed; and a second slot segment disposed along the longitudinal axis to a second side of the RF feed.

7. The apparatus of claim 6, wherein the RF feed is disposed at an off-center location of the elongated opening.

8. The apparatus of claim 6, wherein the RF feed is at least one of a track feed, a co-planar feed, a trace feed, a coaxial feed, twin-lead lines, or a waveguide.

9. The apparatus of claim 6, further comprising a floating metallic member disposed between the elongated opening and the edge of the ground plane.

10. The apparatus of claim 6, wherein the inverted slot antenna comprises:

a third slot segment coupled to the first slot segment at a first bend of the inverted slot antenna, wherein the third slot segment is substantially orthogonal to the first slot segment; and a fourth slot segment coupled to the second slot segment at a second bend of the inverted slot antenna, wherein the fourth slot segment is substantially orthogonal to the second slot segment, and wherein the open circuits are at distal ends of the third and fourth slot segments.

11. The apparatus of claim 10, wherein the distal ends of the third and fourth slot segments are disposed on a same edge of the ground plane.

12. The apparatus of claim 6, wherein:

the first end of the inverted slot antenna is at a first edge of the ground plane, and the second end of the inverted slot antenna is at a second edge of the ground plane.

13. The apparatus of claim 6, further comprising a circuit board comprising a ground plane, wherein the ground plane of the circuit board is the metallic member.

14. The apparatus of claim 6, wherein the metallic member is a structural member of an electronic device.

15. The apparatus of claim 6, wherein the inverted slot antenna is configured to provide a plurality of resonant modes.

16. The apparatus of claim 6, wherein the inverted slot antenna is configured to:

radiate electromagnetic energy in a first frequency range of a wireless local area network (WLAN) frequency band; and radiate electromagnetic energy in a second frequency range of the WLAN frequency band, wherein the second frequency range is higher than the first frequency range.

17. The apparatus of claim 6, wherein the inverted slot antenna is configured to:

radiate electromagnetic energy in a first frequency range of a cellular frequency band; and a second frequency range of the cellular frequency band, wherein the second frequency range is higher than the first frequency range.

18. The apparatus of claim 6, wherein metallic member is at least one of:

a structural member that at least partially supports at least one of a display of an electronic device;

a user input device of the electronic device, a circuit board of the electronic device;

a metallic housing of the electronic device;

a metal portion of a non-metallic housing of the electronic device; or a metallic bezel of the electronic device.

19. The apparatus of claim 6, wherein the elongated opening comprises:

a first side portion that extends from a first end at the edge of the metallic member towards a first bend in a first direction;

a middle portion comprising the first slot segment and the second slot segment, wherein:

the first slot segment that extends from the first bend towards the second slot segment, and the second slot segment comprises a second bend in a second direction that is substantially perpendicular to the first direction; and a second side portion that extends from the second bend towards a second end at the edge of the metallic member in a third direction that is substantially parallel to the first direction.

20. The apparatus of claim 19, wherein a ground stub extends out from the middle portion in the third direction.

21. The apparatus of claim 19, wherein:

the middle portion comprises two separate slot openings, and the RF feed is coupled to feed the two separate slot openings.

22. A method of operating an electronic device, comprising:

applying a first current at a radio frequency (RF) feed coupled to an inverted slot antenna formed in a metallic member, wherein:

the inverted slot antenna comprises an elongated slot opening comprising a first open end and a second open end, the first open end and the second open end are disposed at an edge of a ground plane to operate as open circuits when the inverted slot antenna is radiating, a first side portion that extends from the first open end at the edge of the metallic member towards a first bend in a first direction, a middle portion that extends from the first bend towards a second bend in a second direction that is substantially perpendicular to the first direction, and a second side portion that extends from the second bend towards the second open end at the edge of the metallic member in a third direction that is substantially parallel to the first direction, and a ground stub extends out from the middle portion in the third direction; and in response to the applying, radiating electromagnetic energy from the inverted slot antenna to communicate information to another device in response to the first current.

23. The method of claim 22, wherein the radiating the electromagnetic energy comprises:

radiating the electromagnetic energy in a first resonant mode; and radiating the electromagnetic energy in a second resonant mode.

24. The method of claim 23, wherein the radiating the electromagnetic energy comprises:

radiating the electromagnetic energy in a first frequency range of a wireless local area network (WLAN) frequency band; and radiating the electromagnetic energy in a second frequency range of the WLAN frequency band.

25. The method of claim 23, wherein the radiating the electromagnetic energy comprises:

radiating the electromagnetic energy in a first frequency range of a cellular frequency band; and radiating the electromagnetic energy in a second frequency range of the cellular frequency band.

* * * * *